US012152371B2

(12) United States Patent
Young

(10) Patent No.: US 12,152,371 B2
(45) Date of Patent: Nov. 26, 2024

(54) MOTOR CONTROL FOR ELECTRICALLY POWERED POWER MACHINE

(71) Applicant: Doosan Bobcat North America, Inc., West Fargo, ND (US)

(72) Inventor: Christopher Young, Fargo, ND (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 133 days.

(21) Appl. No.: 18/157,256

(22) Filed: Jan. 20, 2023

(65) Prior Publication Data

US 2023/0228058 A1 Jul. 20, 2023

Related U.S. Application Data

(60) Provisional application No. 63/301,462, filed on Jan. 20, 2022.

(51) Int. Cl.

| | |
|---|---|
| ***H02K 17/32*** | (2006.01) |
| ***E02F 9/20*** | (2006.01) |
| ***E02F 9/26*** | (2006.01) |
| ***H02K 23/68*** | (2006.01) |
| ***H02K 27/30*** | (2006.01) |
| *E02F 3/34* | (2006.01) |
| *E02F 3/42* | (2006.01) |
| *E02F 3/43* | (2006.01) |

(52) U.S. Cl.
CPC ..... *E02F 9/207* (2013.01); *E02F 9/2095* (2013.01); *E02F 9/264* (2013.01); *E02F 3/3414* (2013.01); *E02F 3/422* (2013.01); *E02F 3/431* (2013.01)

(58) Field of Classification Search
CPC ..... E02F 9/207; E02F 9/2095; E02F 9/264
USPC ..... 318/434
See application file for complete search history.

(56) References Cited

U.S. PATENT DOCUMENTS

| | | | | |
|---|---|---|---|---|
| 2010/0138108 | A1* | 6/2010 | Kajino | B60G 17/016 701/38 |
| 2011/0138925 | A1* | 6/2011 | Pirker | G01N 3/165 73/788 |
| 2018/0072306 | A1* | 3/2018 | Yamazaki | B60K 6/54 |
| 2020/0181874 | A1 | 6/2020 | Mahrenholz | |
| 2021/0269017 | A1* | 9/2021 | Araki | B60W 30/045 |
| 2021/0270004 | A1 | 9/2021 | Durkin et al. | |

FOREIGN PATENT DOCUMENTS

| | | | |
|---|---|---|---|
| EP | 3702311 | A1 | 9/2020 |

OTHER PUBLICATIONS

International Searching Authority, International Search Report and Written Opinion issued in corresponding PCT Application No. PCT/US2023/060985, mailed Jun. 23, 2023 [15 pgs].

* cited by examiner

*Primary Examiner* — Erick D Glass
(74) *Attorney, Agent, or Firm* — Quarles & Brady LLP

(57) ABSTRACT

A power machine can include a frame, a lift arm, and one or more electrical devices for control of one or more work elements. The electrical devices can be controlled to improve positional accuracy for work elements during work operations, to improve power management and customer experience (e.g., to provide smoother ride during drive operations), and to provide float functionality for work elements.

20 Claims, 8 Drawing Sheets

MOTOR CONTROL FOR ELECTRICALLY POWERED POWER MACHINE

CROSS-REFERENCE TO RELATED APPLICATIONS

This application claims priority to U.S. provisional patent application No. 63/301,462, filed Jan. 20, 2022, the entirety of which is incorporated herein by reference.

BACKGROUND

This disclosure is directed toward power machines. More particularly, the present disclosure is directed to power machines that operate in whole or in part under electrical power. Power machines, for the purposes of this disclosure, include any type of machine that generates power for the purpose of accomplishing a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Conventional power machines can include hydraulic systems and related components that are configured to use output from a power source (e.g., an internal combustion engine) to perform different work functions. More specifically, hydraulic motors may be configured to power movement of a power machine, and hydraulic actuators (e.g., hydraulic cylinders) may be used to move a lift arm structure attached to the power machine, to tilt or otherwise move an implement connected to the lift arm structure, or execute other operations.

The discussion above is merely provided for general background information and is not intended to be used as an aid in determining the scope of the claimed subject matter.

SUMMARY

Some examples of the present disclosure provide a power machine for movably operating an implement or conducting other operations. The power machine can include a main frame that supports an operator station and a lift arm structure.

Some examples provide a power machine that includes a main frame, an electrical power source supported by the main frame, a drive system configured to be powered by the electrical power source to provide tractive power to move the main frame over terrain, and a lift arm structure supported by the main frame. The lift arm structure can include a lift arm, an implement carrier supported by the lift arm, and one or more electrical actuator configured to be powered by the electrical power source to one or more of: move the lift arm relative to the main frame, or move the implement carrier relative to the lift arm. A control system can include one or more control devices configured to, during a startup mode of the power machine: receive an operator input for a movement of at least one electrical actuator of the one or more electrical actuators in a first predetermined direction; based on the received operator input, command movement of the at least one electrical actuator in the first predetermined direction until at least one of: the at least one electrical actuator reaches a predetermined reference position, or the control system no longer receives the operator input; and in response to the at least one electrical actuator reaching the predetermined reference position, determining an actual position of the at least one electrical actuator based on the predetermined reference position.

In some examples, receiving additional operator inputs can cause the control system to command additional movement of the at least one electrical actuator. The one or more control devices can be configured to determine an actual position of the at least one electrical actuator, corresponding to the additional movement, based on sensed movement relative to the predetermined reference position.

In some examples, commanding the movement of the at least one electrical actuator in the first predetermined direction can include commanding the movement with less than or equal to a predetermined speed that can be slower than a rated operational speed of the at least one electrical actuator.

In some examples, commanding the movement of the at least one electrical actuator in the first predetermined direction can include commanding the movement with less than or equal to the predetermined speed regardless of a requested speed, indicated by the operator input, that exceeds the predetermined speed.

In some examples, the control system can include a resolver in communication with the at least one electrical actuator to track relative movement of the at least one electrical actuator, wherein one or more control devices can be configured to determine the actual position further based on the tracking by the resolver of the relative movement of the at least one electrical actuator.

In some examples, the received operator input can correspond to a lift arm command, and the first predetermined direction can correspond to a lowering of the lift arm.

In some examples, the received operator input can correspond to an implement carrier command, and the first predetermined direction can correspond to a roll-back of the implement carrier.

In some examples, the one or more control devices can be configured to command the movement of the at least one electrical actuator in the first predetermined direction after, and further based on, determining that a physical state condition of the power machine can be satisfied.

Some examples, provide a method of operating a power machine. An operator input for a movement of at least one electrical actuator of the power machine can be received. A component of the operator input that corresponds to a homing direction can be determined. Based upon the power machine being in a startup mode, and upon determining that the component is a non-zero component: while the component remains a non-zero component, movement of the at least one electrical actuator can be commanded in the homing direction with a homing speed until the at least one electrical actuator reaches a predetermined reference position; and subsequent commanded movement of the at least one electrical actuator can be tracked based on relative movement from the predetermined reference position.

In some examples, based upon the power machine being in the startup mode, and upon determining that the component is zero, movement of the at least one electrical actuator can be commanded in a direction corresponding to the operator input and movement of the at least one electrical actuator can be tracked based on relative movement from a predicted reference position.

In some examples, during a shutdown of the power machine that precedes the power machine being in the startup mode, a shutdown position of the at least one electrical actuator can be determined. During the startup mode, determining the predicted reference position can be based on the determined shutdown position.

Some examples provide a power machine with a main frame, an electrical power source supported by the main frame, and a lift arm structure supported by the main frame. The lift arm structure can include a lift arm, an implement carrier supported by the lift arm, and one or more electrical actuators can be configured to raise and lower the lift arm relative to the main frame. A control system can include one or more control devices configured to operate the lift arm structure in a float mode whereby the one or more electrical actuators permit movement of the lift arm structure relative to the main frame in response to external forces.

In some examples, operating the lift arm structure in the float mode can include the one or more control devices selectively powering the one or more electrical actuators to resist but not stop the movement of the lift arm structure in response to the external forces.

In some examples, the external forces include gravitational forces.

In some examples, selectively powering the one or more electrical actuators to resist but not stop the movement of the lift arm can include controlling the one or more electrical actuators to prevent movement of the lift arm, by the external forces, at speeds that exceed a threshold speed.

In some examples, selectively powering the one or more electrical actuators to resist but not stop the movement of the lift arm can include providing zero operational power to the one or more electrical actuators when a present speed of the lift arm can be zero.

Some examples provide a method of controlling a lift arm of a power machine with an electronic control system. A float mode can be determined to be an active operational mode for the power machine. Based on the float mode being the active operational mode, operation of one or more electrical actuators can be controlled to raise and lower the lift arm of the power machine so that: a present speed of the lift arm remains below a threshold float speed for operation of the lift arm; and the one or more electrical actuators are not powered to actively move the lift arm.

Some examples include, based on the float mode being the active operational mode, controlling operation of the one or more electrical actuators so that the one or more electrical actuators can be not powered to hold position for the lift arm.

Some examples include, based on the float mode being the active operational mode, controlling operation of the one or more electrical actuators so that the one or more electrical actuators can be powered to hold position for the lift arm against the force of gravity.

Some examples include, based on the float mode being the active operational mode, controlling operation of the one or more electrical actuators so that the one or more electrical actuators can be not powered to hold position for the lift arm against net external forces exceeding the force of gravity in a direction of gravity.

In some examples, the float mode can be determined to be the active operational mode based on the electronic control system receiving a user input corresponding to a mode selection.

Some examples provide a power machine that includes a main frame, an electrical power source supported by the main frame, and a drive system. The drive system can include: one or more drive motors powered by the electrical power source and operatively coupled to tractive elements to provide tractive power for travel over terrain, and a suspension system that secures the tractive elements to the main frame. A control system can include one or more control devices configured to control drive speed of the one or more drive motors according to a first mode to execute precision operations, and according to a second mode to compensate for travel-induced oscillations on the suspension system. Under the second mode the control system can control the drive speed with substantially reduced integral gain as compared to the first mode.

In some examples, under the second mode the control system can control the drive speed by implementing proportional control without an integral control term.

In some examples, under the second mode, the control system can control the drive speed with a proportional-integral-derivative (PID) control loop that can include an effectively zero integral gain.

In some examples, the control system can be configured to implement the PID control loop under the first mode with an effectively non-zero integral gain.

In some examples, the control system can be configured to implement the PID control loop under the first mode with a zero integral gain.

In some examples, the control system can be configured to selectively operate in either of the first mode or the second mode in response to an operator input that indicates a selected one of the first or second modes.

In some examples, the control system can be configured to selectively operate in either of the first mode or the second more based on monitoring operation of one or more actuators of the power machine.

In some examples, the tractive elements can be tracked tractive elements.

Some examples provide a method of controlling drive operations of a power machine. A selection of a first drive mode or a second drive mode can be received. The power machine can be operated according to the selected first or second drive mode. In the first drive mode, speed control of one or more electrical drive motors of the power machine can be implemented with a proportional-integral-derivative (PID) control loop. In the second drive mode, speed control of the one or more electrical drive motors can be implemented with a proportional control loop.

In some examples, the first drive mode can be a precision control drive mode.

In some examples, the second drive mode can be a hydraulic-emulation drive mode.

In some examples, the second drive mode can not include a proportional-integral-derivative control loop.

In some examples, the proportional control loop can correspond to the PID control loop of the first drive mode, implemented with effectively zero integral gain.

Some examples provide a method of controlling drive operations of a power machine. A selection of a precision control drive mode or a hydraulic-emulation drive mode can be received. One or more drive motors that can be powered by an electrical power source and are operatively coupled to tractive elements can be electronically controlled to provide tractive power for travel over terrain. In response to receiving the selection of the precision control drive mode, the one or more drive motors can be electronically controlled with effectively non-zero integral gain. In response to receiving the selection of the hydraulic-emulation drive mode, the one or more drive motors can be electronically controlled with effectively zero integral gain.

In some examples, the one or more drive motors can be controlled with a first control loop with effectively non-zero integral gain in response to the selection of the precision drive mode, and can be controlled with the first control loop with effectively zero integral gain in response to the selection of the hydraulic-emulation drive mode.

In some examples, the one or more drive motors can be controlled with the first control loop with zero integral gain in response to the selection of the hydraulic-emulation drive mode.

In some examples, the one or more drive motors can be controlled with zero integral gain in response to receiving the selection of the hydraulic-emulation drive mode.

In some examples, the one or more drive motors can be controlled with a proportional-integral-derivative (PID) control loop with the effectively zero integral gain in response to receiving the selection of the hydraulic-emulation drive mode.

In some examples, receiving the selection can include receiving a user input that indicates a commanded drive mode.

In some examples, receiving the selection can include automatically identifying the selection based on identifying a commanded or actual movement of a non-tractive actuator of the power machine.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

DETAILED DESCRIPTION

Figure 1:
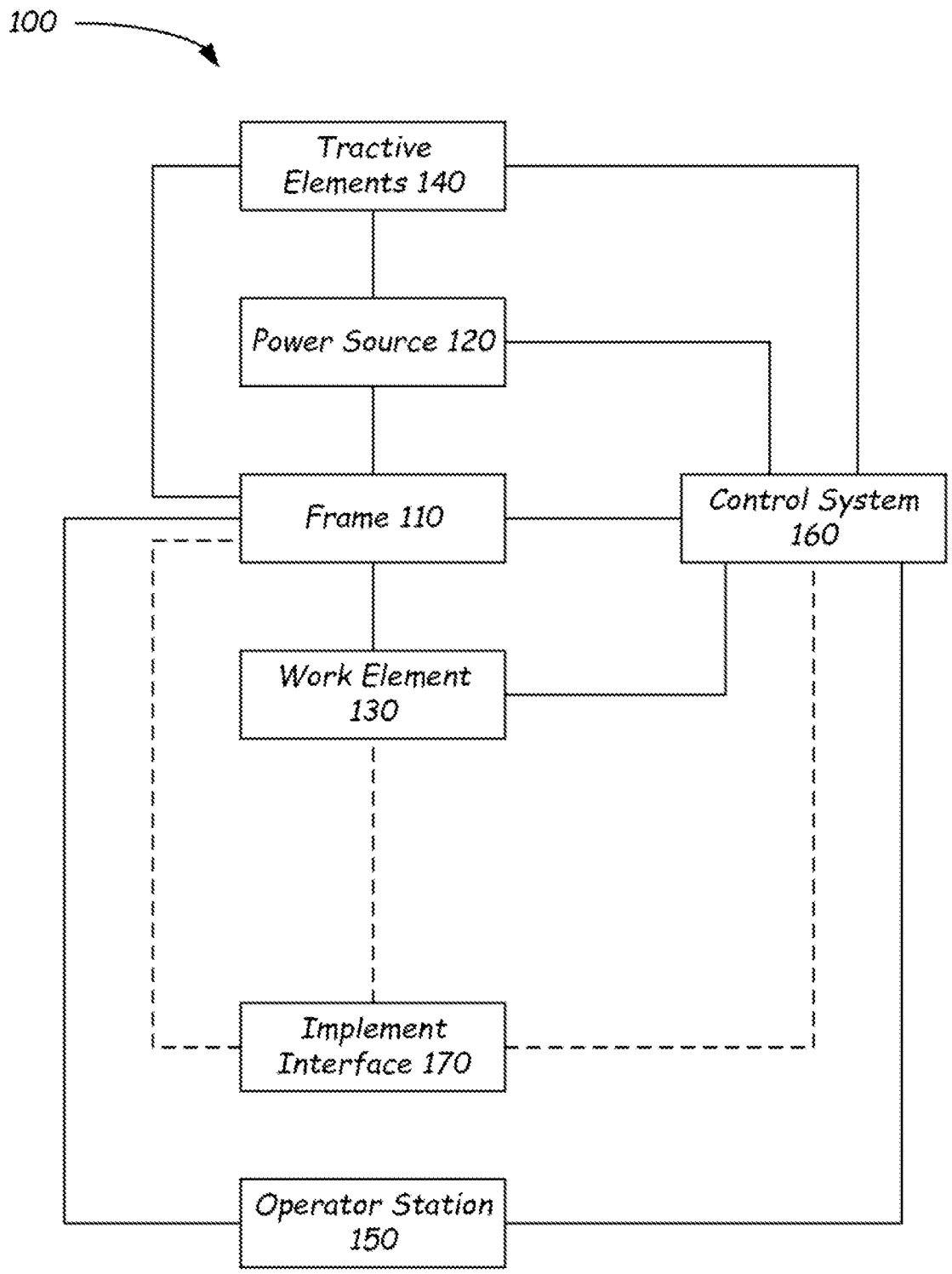
FIG. 1 is a block diagram illustrating functional systems of a representative power machine on which examples of the present disclosure can be advantageously practiced.

The concepts disclosed in this discussion are described and illustrated with reference to exemplary arrangements. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

While the power machines disclosed herein may be embodied in many different forms, several specific embodiments are discussed herein with the understanding that the embodiments described in the present disclosure are to be considered only exemplifications of the principles described herein, and the disclosed technology is not intended to be limited to the examples illustrated.

Some discussion below describes improved components and configurations for power machines, including components and configurations that use electrical (e.g., as opposed to hydraulic) power to operate certain power machine components or otherwise implement certain power machine functionality. In some examples, electrically powered components can be mounted to a frame of a power machine to selectively move work elements of the power machine, including lift arms or implement carriers. In some examples, electrically powered components can provide motive power for a power machine, including for tracked power machines (e.g., compact tracked loaders).

Correspondingly, some examples can provide improvements over conventional power machines, including power machines that use hydraulic components for certain operations and other machines with conventionally controlled electrical actuators. For example, under conventional approaches, accurately tracking position of electronically controlled work elements may require either the inclusion of complex or expensive position sensor or calibration operations that may not be compatible in the context of loaders or other work vehicles. In this regard, some examples of the disclosure can include systems and methods to control homing operations for lift arms or other work elements, including calibration of lift arm position during startup operations with homing movements based on particular operator inputs.

As another example, some configurations can improve ride control for power machines, with corresponding improvements in operator comfort and battery life. During driving operations for a power machine, conventional control of drive motor speed can sometimes result in relatively large or otherwise undesirable oscillations in power demand and in physical structures of the power machine. For example, relatively fine control of motor speed for power machines with torsional (or other) suspension systems can result in relatively large oscillatory movement of the suspension systems and corresponding large variations in power delivery from a power source (e.g., rapid swings between full discharge power and full charging power). Some examples of the disclosure can include systems and methods for selectively eliminating integral control from control loops for drive speed control, to reduce these types of oscillations and thus help to both reduce wear on power system components and improve operator comfort.

As still another example, some configurations can provide float operation for electrically powered lift arms. For example, when a power machine is operating in a float mode, electrical actuators for raising and lowering a lift arm can be controlled to allow the lift arm to move under external forces (e.g., gravity or ground contact) but not to actively move the lift arm (i.e., not to cause the lift arm to move in a direction that corresponds to a powered direction of the relevant actuator). In some examples, electrical lift actuators can be controlled to provide back force to ensure that a lift arm does not move with excessive speed during float operations (e.g., under the force of gravity on a loaded bucket), so as not to be powered to hold the lift arm at a present position, and so as not to actively move the lift arm.

Figure 2:
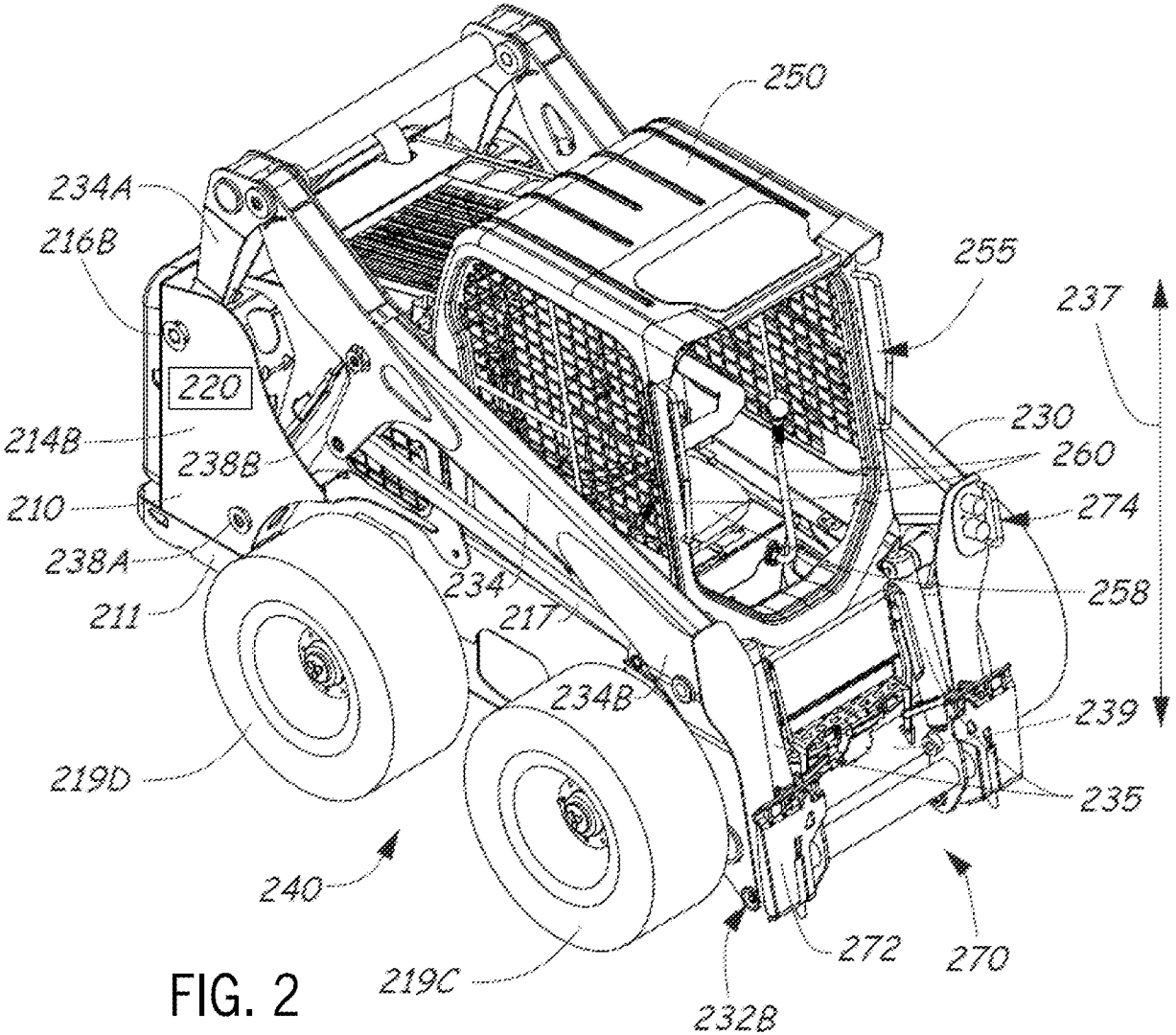
FIG. 2 is a perspective view showing generally a front of a power machine on which examples disclosed in this specification can be advantageously practiced.
Figure 3:
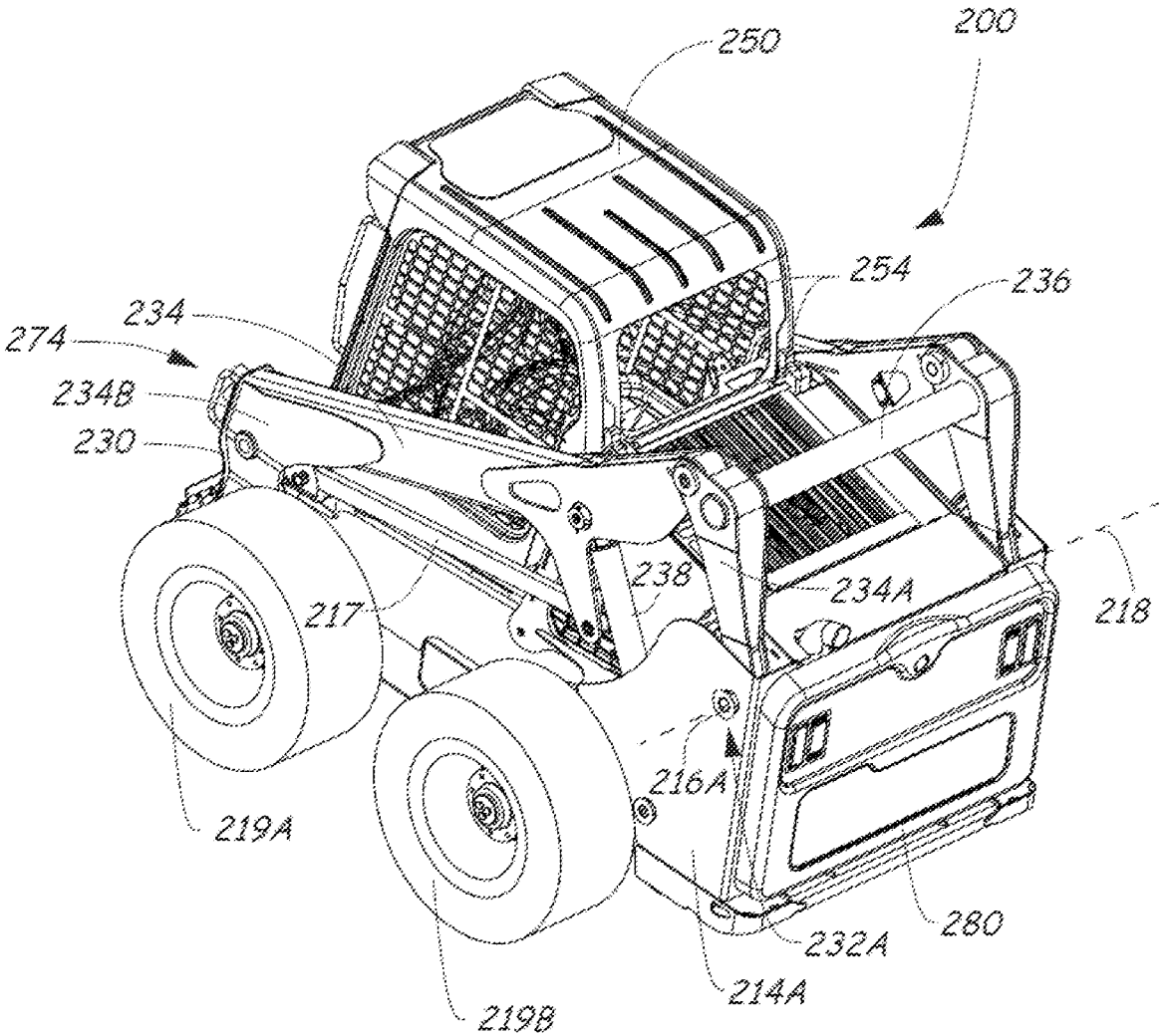
FIG. 3 is a perspective view showing generally a back of the power machine shown in FIG. 2.

These concepts can be practiced on various power machines, as will be described below. A representative power machine on which the examples can be practiced is illustrated in diagram form in FIG. 1 and one example of such a power machine is illustrated in FIGS. 2-3 and described below before any examples are disclosed. For the sake of brevity, only one power machine is illustrated and discussed as being a representative power machine. However, as mentioned above, the examples below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

FIG. 1 is a block diagram that illustrates the basic systems of a power machine 100, which can be any of a number of different types of power machines, upon which the examples discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement to perform the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of different implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. For example, the power machine can be a mower with a mower deck or other mower component as a work element, which may be movable with respect to the frame of the mower. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed examples may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e., from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e., remote from both of the power machine and any implement to which is it coupled) that is capable of controlling at least some of the operator-controlled functions on the power machine.

FIGS. 2-3 illustrate a loader 200, which is one particular example of a power machine of the type illustrated in FIG. 1 where the examples discussed below can be advantageously employed. Loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements. Correspondingly, although some example power machines discussed herein are presented as skid-steer power machines, some examples disclosed herein can be implemented on a variety of other power machines. For example, some configurations can be implemented on compact loaders or compact excavators that do not accomplish turns via skidding.

Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. Skid-steer loader 200 is described herein to provide a reference for understanding one environment on which the examples described below related to track assemblies and mounting elements for mounting the track assemblies to a power machine may be practiced. The loader 200 should not be considered limiting especially as to the description of features that loader 200 may have described herein that are not essential to the disclosed examples and thus may or may not be included in power machines other than loader 200 upon which the examples disclosed below may be advantageously practiced. Unless specifically noted otherwise, examples disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220, the power system being capable of generating or otherwise providing power for operating various functions on the power machine. Power system 220 is shown in block diagram form but is located within the frame 210. Frame 210 also supports a work element in the form of a lift arm assembly 230 that is powered by the power system 220 and that can perform various work tasks. As loader 200 is a work vehicle, frame 210 also supports a traction system 240, which is also powered by power system 220 and can propel the power machine over a support surface. The lift arm assembly 230 in turn supports an implement interface 270, which includes an implement carrier 272 that can receive and secure various implements to the loader 200 for performing various work tasks and power couplers 274, to which an implement can be coupled for selectively providing power to an implement that might be connected to the loader. Power couplers 274 can provide sources of hydraulic or electric power or both. The loader 200 includes a cab 250 that defines an operator station 255 from which an operator can manipulate various control devices 260 to cause the power machine to perform various work functions. Cab 250 can be pivoted back about an axis that extends through mounts 254 to provide access to power system components as needed for maintenance and repair.

The operator station 255 includes an operator seat 258 and a plurality of operation input devices, including control levers 260 that an operator can manipulate to control various machine functions. Operator input devices can include buttons, switches, levers, sliders, pedals and the like that can be stand-alone devices such as hand operated levers or foot pedals or incorporated into hand grips or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 200 include control of the tractive elements 219, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include and/or interact with the examples discussed below can have various different frame components that support various work elements. The elements of frame 210 discussed herein are provided for illustrative purposes and frame 210 is not the only type of frame that a power machine on which the examples can be practiced can employ. Frame 210 of loader 200 includes an undercarriage or lower portion 211 of the frame and a mainframe or upper portion 212 of the frame that is supported by the undercarriage. The mainframe 212 of loader 200, in some examples is attached to the undercarriage 211 such as with fasteners or by welding the undercarriage to the mainframe. Alternatively, the mainframe and undercarriage can be integrally formed. Mainframe 212 includes a pair of upright portions 214A and 214B located on either side and toward the rear of the mainframe that support lift arm assembly 230 and to which the lift arm assembly 230 is pivotally attached. The lift arm assembly 230 is illustratively pinned to each of the upright portions 214A and 214B. The combination of mounting features on the upright portions 214A and 214B and the lift arm assembly 230 and mounting hardware (including pins used to pin the lift arm assembly to the mainframe 212) are collectively referred to as joints 216A and 216B (one is located on each of the upright portions 214) for the purposes of this discussion. Joints 216A and 216B are aligned along an axis 218 so that the lift arm assembly is capable of pivoting, as discussed below, with respect to the frame 210 about axis 218. Other power machines may not include upright portions on either side of the frame or may not have a lift arm assembly that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports a pair of tractive elements in the form of wheels 219A-D on either side of the loader 200.

The lift arm assembly 230 shown in FIGS. 2-3 is one example of many different types of lift arm assemblies that can be attached to a power machine such as loader 200 or other power machines on which examples of the present discussion can be practiced. The lift arm assembly 230 is what is known as a vertical lift arm, meaning that the lift arm assembly 230 is moveable (i.e., the lift arm assembly can be raised and lowered) under control of the loader 200 with respect to the frame 210 along a lift path 237 that forms a generally vertical path. Other lift arm assemblies can have different geometries and can be coupled to the frame of a loader in various ways to provide lift paths that differ from the radial path of lift arm assembly 230. For example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the inventive concepts set forth in this discussion are limited by the type or number of lift arm assemblies that are coupled to a particular power machine.

The lift arm assembly 230 has a pair of lift arms 234 that are disposed on opposing sides of the frame 210. A first end 232A of each of the lift arms 234 is pivotally coupled to the power machine at joints 216 and a second end 232B of each of the lift arms is positioned forward of the frame 210 when in a lowered position as shown in FIG. 2. Joints 216 are located toward a rear of the loader 200 so that the lift arms extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. Cross member 236 provides increased structural stability to the lift arm assembly 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm assembly 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e., along a pre-determined path) as is the case in the lift arm assembly 230 shown in FIG. 2.

Some power machines have lift arm assemblies with a single lift arm, such as is known in excavators or even some loaders and other power machines. Other power machines can have a plurality of lift arm assemblies, each being independent of the other(s).

An implement interface 270 is provided proximal to a second end 232B of the lift arm assembly 234. The implement interface 270 includes an implement carrier 272 that is capable of accepting and securing a variety of different implements to the lift arm 230. Such implements have a complementary machine interface that is configured to be engaged with the implement carrier 272. The implement carrier 272 is pivotally mounted at the second end 232B of the arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative ease. For example, machines with implement carriers can provide an actuator between the implement carrier and the lift arm assembly, so that removing or attaching an implement does not involve removing or attaching an actuator from the implement or removing or attaching the implement from the lift arm assembly. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes an implement power source 274 available for connection to an implement on the lift arm assembly 230. The implement power source 274 includes pressurized hydraulic fluid port to which an implement can be removably coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The implement power source 274 also exemplarily includes electrical conduits that are in communication with a data bus on the excavator 200 to allow communication between a controller on an implement and electronic devices on the loader 200.

Frame 210 supports and generally encloses the power system 220 so that the various components of the power system 220 are not visible in FIGS. 2-3. The arrangement of drive pumps, motors, and axles in power machine 200 is but one example of an arrangement of these components. As discussed above, power machine 200 is a skid-steer loader and thus tractive elements on each side of the power machine are controlled together via the output of a single hydraulic pump, either through a single drive motor as in power machine 200 or with individual drive motors. Various other configurations and combinations of hydraulic drive pumps and motors can be employed as may be advantageous.

The description of power machine 100 and loader 200 above is provided for illustrative purposes, to provide illustrative environments on which the examples discussed below can be practiced. While the examples discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 4:
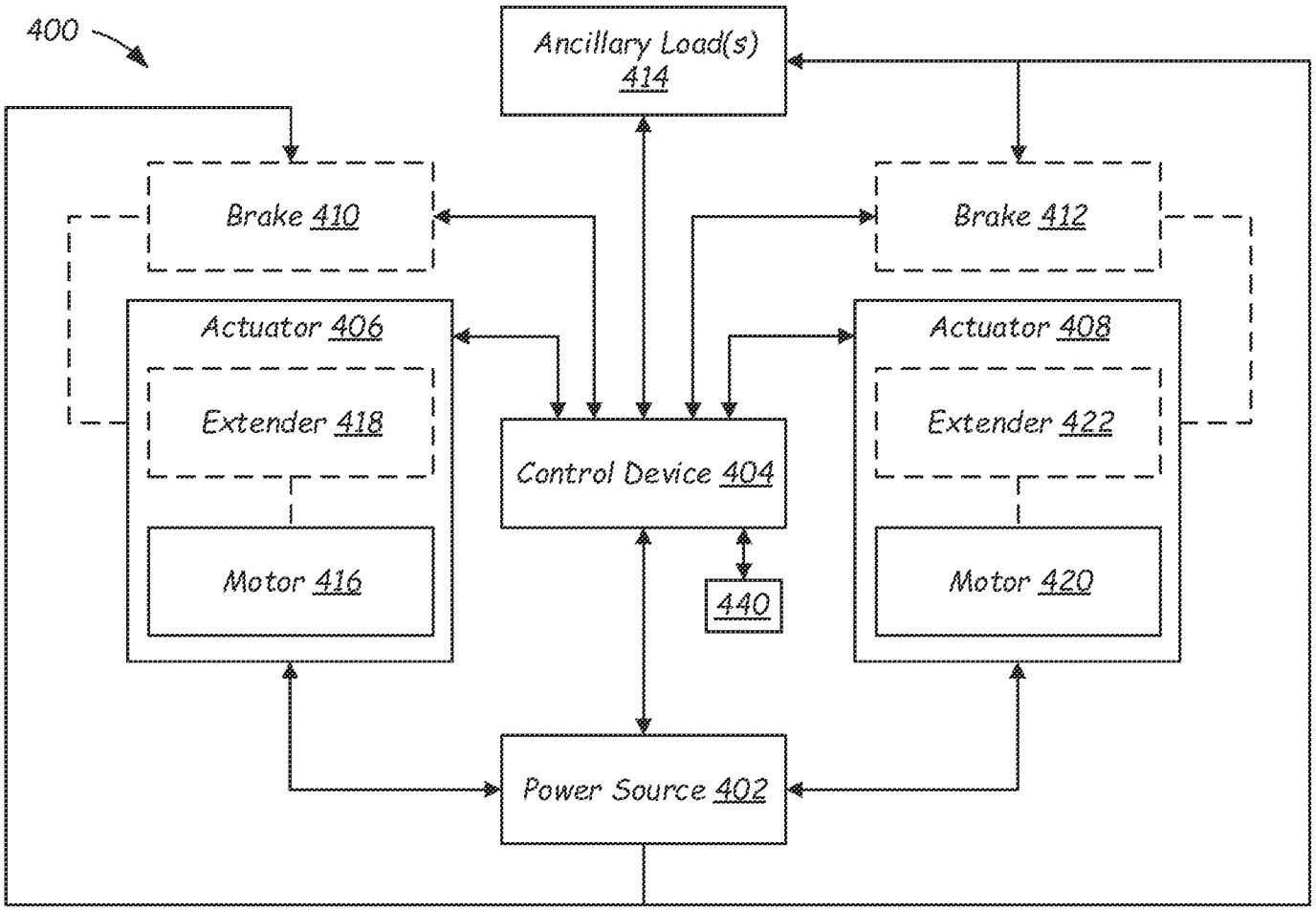
FIG. 4 is a block diagram illustrating components of a power system of a loader such as the loader of FIGS. 2 and 3.

FIG. 4 shows a schematic illustration of a block diagram of a power machine 400, which can be any of a number of different types of power machines (e.g., wheeled or tracked skid-steer loaders), including any of the types generally discussed above. To accomplish various work and drive operations, the power machine 400 can include a power source 402, a control device 404, and electrical actuators 406, 408. Either or both of the electrical actuators 406, 408 can be variously configured as one or more drive actuators, or one or more workgroup actuators, and a different number of individual actuators can be provided than is generally shown in FIG. 4. For example, as further discussed below, some power machines can include a left-side and right-side drive actuators, each including a respective electronic drive motor disposed to power an associate tractive element (e.g. an endless track assembly), as well as various extendable (or other) work actuators (e.g., one or more extendable lift arm actuators, one or more extendable tilt actuators, etc.). In some cases, as also shown in FIG. 4, one or more brakes 410, 412 can be configured to stop movement of an associated one or more of the actuators 406, 408, including based on control signals from the control device 404.

In the illustrated example, the power machine 400 can be an electrically powered power machine and thus the power source 402 can include an electrical power source such as, for example, a battery pack that includes one or more battery cells (e.g., lithium-ion batteries). In some examples, the power source 402 can include other electrical storage devices (e.g., a capacitor), and other power sources. In addition, the power machine 400 can, but need not, include an internal combustion engine that provides, via a generator, electrically power to the power source 402 (e.g., to charge one or more batteries of the electrical power source).

Generally, the control device 404 can be implemented in a variety of different ways and can include one or more types or instances of known electronic controllers. For example, the control device 404 can be implemented as known types of processor devices, (e.g., microcontrollers, field-programmable gate arrays, programmable logic controllers, logic gates, etc.), including as part of one or more general or special purpose computers. In addition, the control device 404 can also include or be in operative communication with other computing components, including memory, inputs, output devices, etc. (not shown). In this regard, the control device 404 can be configured to implement some or all of the operations of the processes described herein, which can, as appropriate, be retrieved from or otherwise interact with memory. In some examples, the control device 404 can include multiple control devices (or modules) that can be integrated into a single component or arranged as multiple separate components. In some examples, the control device 404 can be part of a larger control system (e.g., the control system 160 of FIG. 1) and can accordingly include or be in electronic communication with a variety of control modules, including hub controllers, engine controllers, drive controllers, and so on.

In different examples, different types of actuators can be configured to operate under power from the power source 402, including electrical actuators configured as rotary actuators, linear actuators, and combinations thereof. In the example shown in FIG. 4, the actuator 406 is a drive actuator and includes an electrical motor 416 that is configured to provide rotational power to one or more tractive elements (not shown in FIG. 4). As noted above, some power machines can include multiple drive actuators, including as can be arranged for skid-steer operation.

Also as shown in the example of FIG. 4, the actuator 408 is a workgroup actuator and thus includes an electrical motor 420 that is configured to provide rotational power for operation of one or more non-drive work elements (e.g., a lift arm, an implement, etc.). In some cases, the motor 420 can be configured to power movement of an extender 422 (e.g., a lead screw, a ball screw, another similar threaded assembly, or other known components for rotationally powered non-rotational movement), which can convert rotational power of the motor 420 into translational movement of the extender 422 so as to provide translational power to a work element of the power machine 400. For example, the motor 420 can rotate in a first direction to drive extension of the extender 422 and can rotate in a second direction to drive retraction of the extender 422 when the motor rotates in a second rotational direction opposite the first rotational direction. In this way, and depending on how the electrical actuator 406 is coupled to the components of the power machine 400, extension (and retraction) of the electrical actuator 406 can, for example, raise (or lower) a lift arm of the power machine 400, change an attitude an implement of the power machine 400 (e.g., a bucket), etc.

Thus, generally, each motor 416, 420 can be controlled to implement particular functionality for the power machine 400. As generally noted above, different configurations of multiple drive or workgroup actuators can be included in some cases (e.g., multiple instances of the actuators 406, 408 as shown), to provide different functionality for a particular power machine. For example, in some configurations, the power machine 400 can include an electrical actuator that is a first lift actuator on a first lateral side of the power machine 400, an electrical actuator that is a second lift actuator on a second lateral side of the power machine 400, an electrical actuator that is a first tilt actuator that is on a first lateral side of the implement interface of the power machine 400, an electrical actuator that is a second tilt actuator that is on a second lateral side of the implement interface of the power machine 400, an electrical actuator that is a first drive actuator for a first drive system that is on (or otherwise powers one or more tractive elements for) the first lateral side of the power machine 400, and an electrical actuator that is a second drive actuator for a second drive system that is on (or otherwise powers one or more tractive elements for) the second lateral side of the power machine 400.

As also noted above, the brakes 410, 412 can be coupled to (e.g., included in) the respective electrical actuators 406, 408 in some examples. In this regard, a wide variety of known brake systems can be used. For example, one or more brakes can be a mechanical brake that includes a mechanical stop that can be moved into engagement to block movement of a relevant extender or relevant motor, in one or more directions, and can be moved out of engagement to allow movement of the relevant extender or motor. In some cases, a mechanical brake can include an arm that contacts a lead screw of an extender to block further movement of the lead screw. In some examples, one or more electrically powered brakes can be provided (i.e., brake assemblies that include one or more electrical actuators for application of braking force).

As shown in FIG. 4, the power source 402 can be electrically connected to the control device 404, the electrical actuators 406, 408, and the brakes 410, 412 (as appropriate), as well as one or more ancillary loads 414. Thus, the power source 402 can provide power to each motor 416, 420 to drive movement (e.g., extension and retraction) of the respective extenders 418, 422, to the control device 404, to each brake 410, 412 (as appropriate), to each of the ancillary load(s) 414, etc. Further, the power source can provide power to the ancillary loads 414 (i.e., loads not associated with providing tractive or workgroup power) for various ancillary functionality. For example, ancillary loads can include a climate control system (e.g., including a heater, an air-conditioning system, a fan, etc.), a sound system (e.g., a speaker, a radio, etc.), etc. In some cases, ancillary loads 414 may be treated with lower priority according to certain power management modes.

As shown in FIG. 4, the control device 404 can be in electrical communication with the power source 402, the actuators 406, 408, the brakes 410, 412 (as appropriate), and the ancillary load(s) 414, and can adjust (e.g., limit) the power delivered from the power source 402 to, or the power consumed by, each of these electrical loads (or others). For example, as appropriate, the control device 404 can adjust (e.g., decrease) the power delivered to each of these electrical loads by adjusting (e.g., decreasing) the current that can be consumed by at least some of these electrical loads. In some cases, the control device 404 can adjust the current delivered to an electrical load by adjusting a driving signal delivered to a current source (e.g., a voltage controlled current source) that can be electrically connected to the electrical load (e.g., integrated within a power electronics driver board, such as a motor driver) to deliver current to the electrical load. For example, the current source can include one or more field-effect transistors, and the driving signal can be the voltage applied to the one or more field-effect transistors to adjust the current delivered and thus the power delivered to the electrical load (e.g., the motor).

In some examples, similarly to each of the electrical loads of the power machine 400, the electrical power source of the power source 402 can include (or can be otherwise electrically connected to) a current source (e.g., a power electronics board) that adjusts (e.g., and can restrict) the amount of power to be delivered to the electrical loads of the power machine 400. In this case, the control device 404 can adjust the driving signal to the electrical power source to adjust the total amount of current and thus the amount of power delivered to the electrical loads of the power machine 400. For example, the control device 404 can adjust the output from the electrical power source 402 to regulate the torque, position, direction, and speed of one or more motors powered by the power source 402.

In some examples, the control device 404 can be configured to determine a present (i.e., temporally current) power usage of one or more actuators or other electrical loads, or a present power delivery from a power source. In some cases, a present power usage or delivery can be measured instantaneously. In some cases, a present power usage or delivery can be measured as an average power delivery over a recent time interval (e.g., a preceding 2 seconds). Thus, for example, the control device 404 can determine a present power usage for each electrical load of the power machine 400, or can determine a present power delivery from the electrical power source of the power source 402.

In some cases, each electrical load of the power machine, and the power source 402 can include or can otherwise be electrically connected to a current sensor to determine the current being provided to (or by) the particular electrical component, and a voltage being provided to (or by) the particular electrical component can also be determined (e.g., based on voltage sensor or a fixed voltage provided by the power source 402). In this way, for example, the control device 404 can receive information about a present voltage and a present current that is delivered to each individual electrical load, or about the present voltage and current that is supplied by the electrical power source of the power machine 400 in total and can thereby determine a present power usage for relevant (e.g., all) electrical loads and for the electrical power source of the power machine 400.

In some examples, the control device 404 can determine a present power usage for the electrical power source of the power machine 400 by adding the present power usage for each relevant electrical load of the power machine 400 (e.g., as determined by multiplying current and voltage for the loads). Alternatively, for example, power can be determined by multiplying the torque and speed of one or more relevant motors. In certain circumstances, it may be advantageous to use either of these known methods. In other cases, the control device 404 can determine a present power usage of the electrical power source of the power machine 400 only by determining the power delivered by the electrical power source. For example, the control device 404 can receive a present value for current delivered by the electrical power source 402 and, based on the voltage of the electrical power source 402, can then determine a total present power usage for the electrical power source. In some cases, the control device 404 can assume a substantially constant voltage for the electrical power source and can then determine the present power usage of the electrical power source by using the constant voltage and the present current value.

In some examples, the electrical power source 402 can include or can be electrically connected to a sensor to sense a present remaining energy of the electrical power source. In some cases, for example, a voltage sensor can sense the voltage of the electrical power source, which can be indicative of the present remaining energy left within the electrical power source (e.g., because the voltage of the electrical power source can be related to the present remaining energy within the electrical power source). Any suitable means for sensing the remaining energy of the electrical power source can be used, including an accounting of how much current is supplied by the energy storage device over time.

In some examples, the power machine 400 can include one or more sensors that can sense various aspects of the power machine 400. For example, the power machine 400 can include a torque sensor for one or more electrical actuators, to sense a present torque of the one or more electrical actuator. In some cases, the torque sensor can be the same as the current sensor electrically connected to the electrical actuator (e.g., because current is related to the torque). As another example, the power machine 400 can include a position sensor for one or more extenders or other components of one or more electrical actuators (as appropriate), including as may sense a present extension amount for an extender of an electrical actuator (e.g., relative to the housing of the electrical actuator). In some cases, this can be a hall-effect sensor, a rotary encoder for the motor (e.g., which can be used to determine the extension amount of actuators with extenders), an optical sensor, etc. In some cases, the power machine 400 can include a resolver (not shown) configured to track relative movement of one or more actuators (e.g., positioned similarly to the resolver 548 of FIG. 5 to track movement of the actuator 518). As yet another example, the power machine 400 can include an angle sensor for one or more pivotable joints (e.g., of the lift arm) to determine a current orientation of the lift arm (and any implement coupled thereto). As yet another example, the power machine 400 can include a speed sensor or an acceleration sensor (e.g., an accelerometer) to respectively determine a current speed or a current acceleration of the entire power machine 400 or of a component thereof. As still yet another example, the power machine 400 can include an inclinometer (e.g., an accelerometer) that can sense the current attitude of a mainframe of the power machine 400 with respect to gravity.

Figure 5:
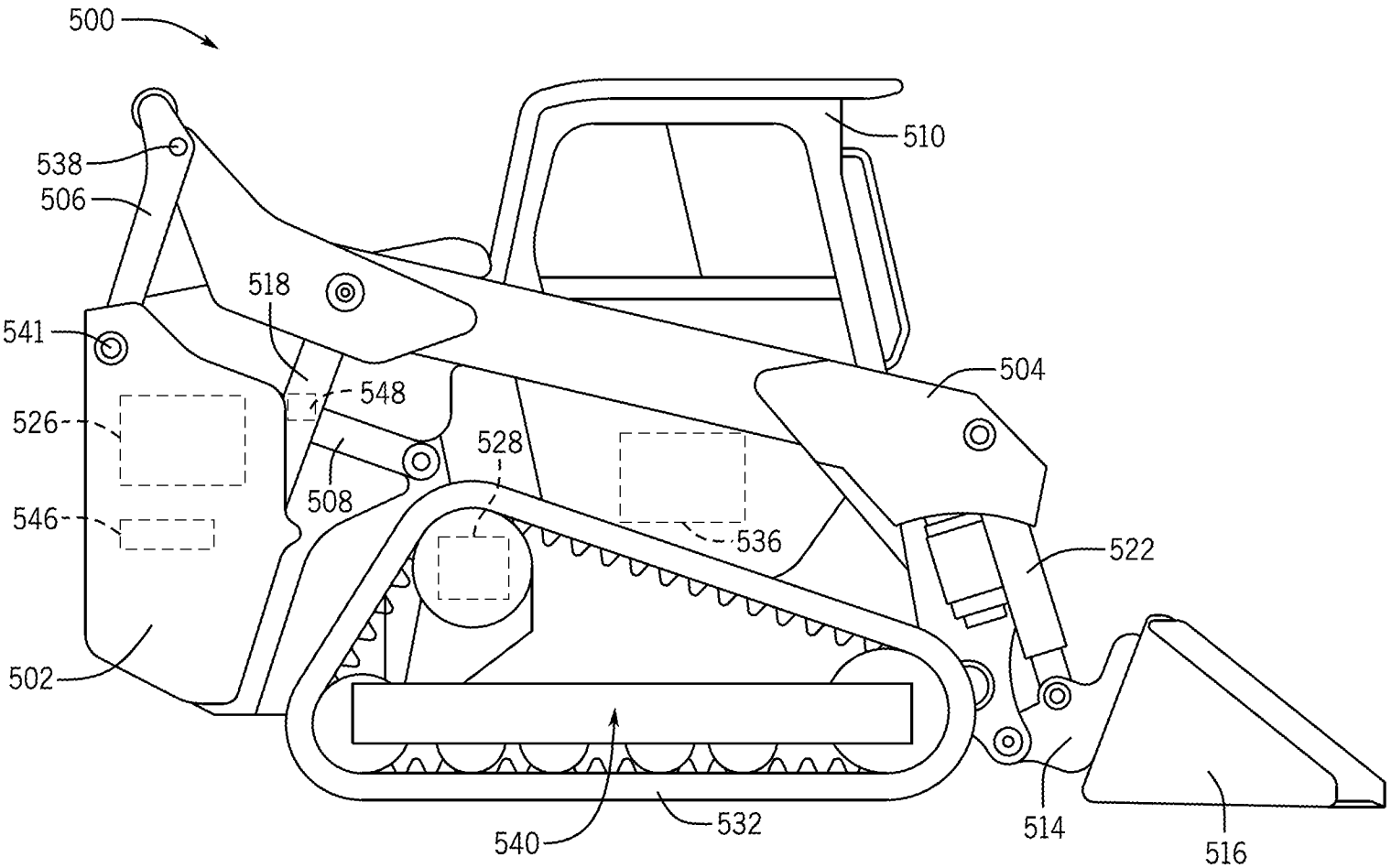
FIG. 5 is a side elevation view showing certain components a power machine in the form of an electrically powered compact tracked loader according to examples of the disclosure.

FIG. 5 shows a side isometric view of an electrically powered power machine 500 with a lift arm in a fully lowered position, which can be a specific implementation of the power machine 200, the power machine 400, etc. As shown in FIG. 5, the power machine 500 can include a main frame 502, a lift arm 504 coupled to the main frame via a follower link 506, a driver link 508 pivotally coupled to the lift arm 504 and the main frame 502, an operator enclosure 510 (e.g., a cab, as shown), an implement interface 514 coupled to an end of the lift arm 504, an implement 516 (e.g., a bucket as shown) coupled to the implement interface 514, an electrical lift actuator 518, an electrical tilt actuators 522, an electrical power source 526, a drive system 528 (e.g., including an electrical drive motor), a traction devices 532 (e.g., an endless track, as shown), and a climate control system 536 (e.g., as generally representative of an overall ancillary electrical load). In some examples, a suspension system 540 (e.g., a torsional suspension system) can be included, to provide improved ride control and overall smoothness of travel. As generally noted above, similar (e.g., substantially identical) other components can be provided symmetrically (or otherwise) on an opposing lateral side of the power machine 500 in some cases, including another electrical lift actuator, another electrical tilt actuator, etc. In addition, various examples can employ various lift arm geometries, including with lift arms structures that do not include driver or follower links.

In some cases, the electrical power source 526 can be implemented in a similar manner as the previously described power sources (e.g., the power source 402). Thus, the electrical power source 526 can include a battery pack including one or more batteries. In general, the electrical power source 526 can supply power to some or all of the electrical loads of the power machine 500. For example, the electrical power source 526 can provide power to the lift electrical actuator 518, the electrical tilt actuator 522, the drive system 528, the climate control system 536, etc.

The power machine 500 can also include a control device 546 that can be in communication with the power source 526 and some (or all) of the electrical loads of the power machine 500, as appropriate. For example, the control device 546 can be in communication with the lift electrical actuator 518, the electrical tilt actuator 522, the drive system 528, the climate control system 536, etc. In this way, the control device 546 can control operation of these components, or related other systems, to adjust how power is routed to each of these electrical loads (e.g., depending on the criteria defined by the particular power management mode) and, correspondingly, how power from the power source 526 is consumed over a given operational function or interval of time.

As noted above, some examples can include control systems or methods to calibrate a position of a lift arm during startup operations for a power machine. For example, when the power machine 500 is started from a powered-down state, the control device 546 may not with certainty know the current position of the lift arm 504 (e.g., as indicated by the current extension distance of the lift actuator 518. Correspondingly, to ensure reliable operation of the lift arm 504, it may be useful to identify a reference (or "home") position for the lift arm 504, which corresponds to a reference position (e.g., extension length) of the lift actuator 518.

In some examples, execution of a homing operation may be beneficially delayed until an appropriate operator input is received. Correspondingly, for example, if the lift arm 504 is to be lowered to a lower mechanical stop that corresponds to a home position for the lift arm 504 and the lift actuator 518, the control device 546 may delay actually commanding the lift arm 504 to lower until an operator has actively commanded the lowering movement.

In some examples, the control device 546 may sometimes control a speed of a homing movement of a work element without regard to a speed of movement that is commanded by a corresponding operator input. For example, during a startup mode and before the lift arm 504 has been homed, the control device 547 may command a lowering movement for homing of the lift arm 504 based on receiving an operator input for a lowering movement, but may control the lift arm 504 to move at or below a homing speed even if the operator command requests a faster movement.

In some examples, the home position may be at a fully lowered position, i.e., a position where the lift arm is engaging a stop on the frame of the machine such that the lift arm may be physically incapable of moving any further in the lowered direction. In other examples, the home position may correspond to a position where the lift arm passes at least one position sensor (e.g., switch) that can sense when the lift arm is in a particular location. In various examples, a power machine may have more than one such limit switch (or other limit sensor), each individually identifiable, and each capable of operating as a home position.

For the purposes of this discussion a startup mode can be the initial period of time when an operator has initiated use of the machine by, for example, turning on a key or other similar actions. Alternatively or in addition, a startup mode may be a period where an operator takes specific actions to initiate or unlock work elements on the machine, including drive systems and lift arm control to cause the machine to move to a fully enabled state, where functions such as the lift arm and drive systems are capable of being operated. Correspondingly, during a startup mode operator-controlled or other powered operation can be prevented for particular actuators, for particular functionality, or for tractive elements or other particular power machine sub-systems.

In some examples, once a home position for a lift arm has been established for a particular startup mode, subsequent operation of the lift arm can be controlled to commanded positions based on the known (e.g., fixed or otherwise previously determined) home position and sensed movement away from the home position. For example, once a home (e.g., fully lowered) position has been established for the lift arm 504, subsequent control of the lift arm 504 can include tracking an actual position (e.g., extension length) of the lift actuator 518 based on the determined home position and relative movement of the lift actuator 518 as sensed by the resolver 548.

In some examples, it may be possible to bypass one or more of the homing operations noted above or to use historical information to approximate present actuator orientation(s) before a homing operation has been completed (e.g., before a homing position has been reached by a relevant actuator). For example, a last position of the lift arm 504 as sensed by the resolver 548 can be stored upon shut-down of the power machine 500, and then compared to a present position sensed by the resolver 548 during a subsequent startup mode. If the stored and present position are consistent, then operational control of the lift arm 504 may sometimes proceed without re-establishing a home position (e.g., via control based on a previously stored home position). Correspondingly, in some cases, a shutdown sequence for a power machine can include an imposed delay between an operator-requested power-down and actual cessation of power for a relevant control device (e.g., the device 546 or a dedicated motor controller) to allow a present resolver position to be appropriately received and stored.

In some examples, other conditions can also be applied, including so that homing operations can be delayed in some cases until certain physical states of the power machine are obtained. For example, a homing operation that requires a lift arm to move (e.g., lower) relative to a main frame of a power machine may be prevented until a door of the power machine is fully closed or other physical state condition of the power machine is satisfied (e.g., a cab door is closed, a seat belt or other safety or restraint system is engaged, a valid access code has been entered or other authorization condition has been met, etc.). In some examples, the homing operation can be interrupted, including when an operator input that initiates the homing operation is stopped. This can allow an operator to abort a homing operation for any reason, should the operator desire to do so.

In some examples, determining a reference position during a startup mode can be implemented for actuators other than lift actuators for lift arms. For example, similar homing operations as are discussed above relative to the lift actuator 518 can be implemented relative to the tilt actuator 522 (e.g., with a fully rolled back position of the implement interface 514 corresponding to a home position for the tilt actuator 522). Accordingly, discussion above should be understood to also be applicable to homing operations relative to the tilt actuator 522, or other actuators, with appropriate variation corresponding to the differing locations and functional roles of the relevant actuator(s).

Figure 6:
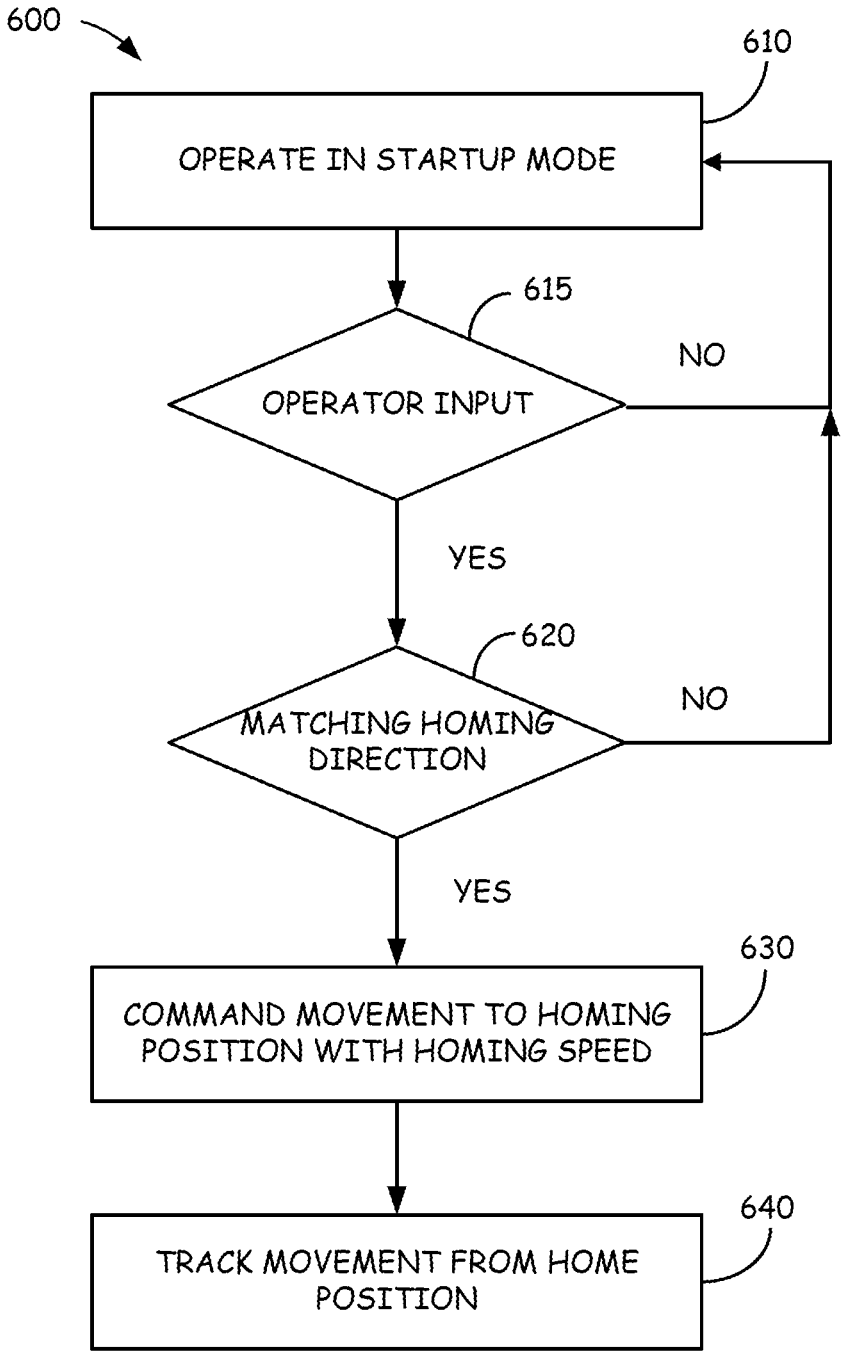
FIGS. 6-8 are flow charts illustrating methods for control of one or more actuators of an electrically powered power machine according to examples of the disclosure.

Referring also to FIG. 6, some implementations can include a method 600 for startup operations of a power machine, which can in some cases implement some or all of the homing functionality discussed above. In the illustrated example, at block 610, the method 600 can include operating a power machine in a startup mode, as may correspond to a predetermined sequence of operations to transition a power machine from a powered-off state to a full operational powered-on state or a fully enabled state.

While in the startup mode, the method 600 can include receiving an operator input at block 615, corresponding to an operator-requested movement of at least one electrical actuator (e.g., one of the actuators 518, 522) to move a corresponding work element of a power machine. Once an operator input is received, the method 600 can include, at block 620, determining whether the operator input includes a non-zero component of the operator input that corresponds to a homing direction. For example, the method 600 can include determining whether an operator input for the lift actuator 518 corresponds to a non-zero lowering command (e.g., toward a fully lowered home location) or whether an operator input for the tilt actuator 522 corresponds to a non-zero command in the roll-back direction (e.g., toward a fully rolled back home location).

In some implementations an operator command may not correspond to non-zero command in a reference direction. In this case, the method 600 may sometimes include moving the relevant actuator in the requested direction (e.g., raising the lift arm 504) according to any relevant constraints of the startup mode (e.g., with limited maximum speed or reduced functionality relative to certain actuators). In some cases (e.g., alternatively), the method 600 can include not moving the relevant actuator at all, according to a corresponding zero-movement constraint of the startup mode. For example, the method 600 can include preventing movement of the relevant actuator, except as needed for homing operations, until a homing position has been reached (e.g., reached as a result of a subsequent operator movement received at block 615, determined at block 620 to command movement in the homing direction).

In some cases, under the method 600, moving an actuator in a direction that is not the homing direction can include tracking movement of the actuator based on relative movement from a predicted position. For example, an estimated starting position of the lift actuator 518 (e.g., as represented by a stored value from a preceding shutdown sequence) can be used along with relative movement as determined by the resolver 548 to track (e.g., estimate) movement of the lift arm 504 even if a home position has not yet been reached. Similar tracking based on sensed (or commanded) movement and stored starting (or other) positions can also be similarly implemented using different types of sensors or actuators.

While the power machine continues to operate in the startup mode and the operator input continues to correspond to a non-zero movement of a relevant actuator in a relevant homing direction, the method 600 can include, at block 630, commanding movement of the relevant actuator toward the homing position. In some cases, operations at block 630 can include commanding an actuator for movement at or below a threshold homing speed that may be less than a maximum possible or maximum rated operational speed for the actuator. For example, regardless of a commanded speed for lowering the lift arm 504 or rolling back the implement interface 514, the method 600 may include limiting the lowering or roll-back speed, respectively, to be at or below a relevant threshold speed during a homing movement (or, generally, for movements before a homing location has been reached). In some cases, such a threshold for homing (or pre-homing) movements can be a reduced-speed threshold that is slower than a rated operational speed of a relevant actuator (e.g., a maximum permitted speed for the actuator during normal tractive or work operations). In some cases, the method 600 can be implemented with different speed thresholds for different actuators, or for movements in different directions (e.g., a lower speed threshold for movements away from a homing direction than for movements toward a homing direction, or vice versa).

Once a home position has been reached, the method 600 can include, at block 640, tracking subsequent movement of an actuator based on the home position. For example, once a home position for the lift arm 504 has been reached, subsequent operations for the lift arm 504 can be controlled based on the home position (e.g., as indicates a reference extension length of the lift actuator 518) and tracked movement relative to the home position as indicated by signals from the resolver 548. If the homing position is not reached because a non-zero signal is removed before reaching the homing position, subsequent non-zero signals from the operator input can re-establish the homing process. In some examples, an operator may be allowed to forego or bypass the homing process.

In some cases, the functionality discussed above (e.g., as implemented in the method 600, other than at block 610) may be beneficially implemented outside the context of a startup mode, or within a startup mode but outside the context of a startup of a machine from an ordinary powered off state. For example, in some cases, homing operations as generally discussed above can be implemented after an operator has engaged a "release," "lift down," or other similar interface (e.g., a corresponding mechanical or virtual button) to automatically reposition a lift arm or other work element (e.g., not under power), or can be implemented after an operator has engaged an emergency stop for a power machine.

Also as noted above, some examples can include control systems or methods to compensate for travel-induced oscillations in a suspension system or for travel-induced fluctuations in power demand for an electrical power source (e.g., as may relate to oscillations of a suspension or may also result on suspension-less vehicles), which may otherwise result in substantial part wear (e.g., capacitor burn-out) and other issues. In particular, it has been discovered that selective operation under control loops with reduced (e.g., zero or effectively zero) integral control terms for drive speed can provide substantial improvements in overall power management. In other words, in some examples, rather than precisely control drive speed of drive actuators of a power machine using proportional-integral-derivative (PID) control, a control systems can selectively control drive speed with proportional but not integral control, i.e., with a control loop having no integral term (e.g., no integration block or operation) also referred to herein as hydraulic-emulation mode. Thus, for example, as implemented for the power machine 500, some examples of the disclosed technology can substantially reduce oscillations of the suspension system 540 and corresponding oscillations in power flow for the electrical power source 526 (e.g., ranging from full power delivery to maximum recharging) as compared to conventional control approaches. In some examples, an integral gain of a control loop for a normal operational mode can be substantially reduced (i.e., reduced by more than 85%) for operation under a hydraulic-emulation mode. In some examples, an integral gain for speed control under a hydraulic-emulation mode can be effectively zero (i.e., with zero or no integral gain, or with integral gain less than 0.005). In some cases, as also noted below, effectively zero integral gain in a hydraulic-emulation mode can result in some steady-state error, which can in turn result in an electric actuator, like a hydraulic actuator, tending to drift slightly against a load.

In some examples, control systems can be configured to selectively operate in different control modes based on the needs of a particular operation. For example, in some implementations, an operator input can indicate whether to operate in a precision drive mode with PID control (and non-zero integral gain), or in a hydraulic-emulation (or other similar) mode that can allow more stable or efficient operation to be implemented, albeit with some loss of precision due to the non-use of integral control. It has been found that in many operations of power machines such as power machines 100 and 200 described above, that precise control of the travel speed of the power machine may not be needed or even desired. For example, control that is too precise can result in the fluctuating power demands such as is mentioned above. To counter the potential losses or other inefficiencies of such fluctuations, the so-called hydraulic-emulation mode provides a drive response that is similar to the operation of a hydrostatic drive motor with the added benefits of reducing power consumption and potential damage to electronic components that provide power to the drive motors. On the other hand, in certain situations where precise operation is required, the PID control can provide more accurate travel speeds. Thus, depending on the needs of a present (or presently commanded) operation, control can be selectively implemented in a hydraulic-emulation mode with correspondingly decreased power fluctuations, or in a default (or other) power mode with non-zero integral control and correspondingly improved precision.

Figure 7:
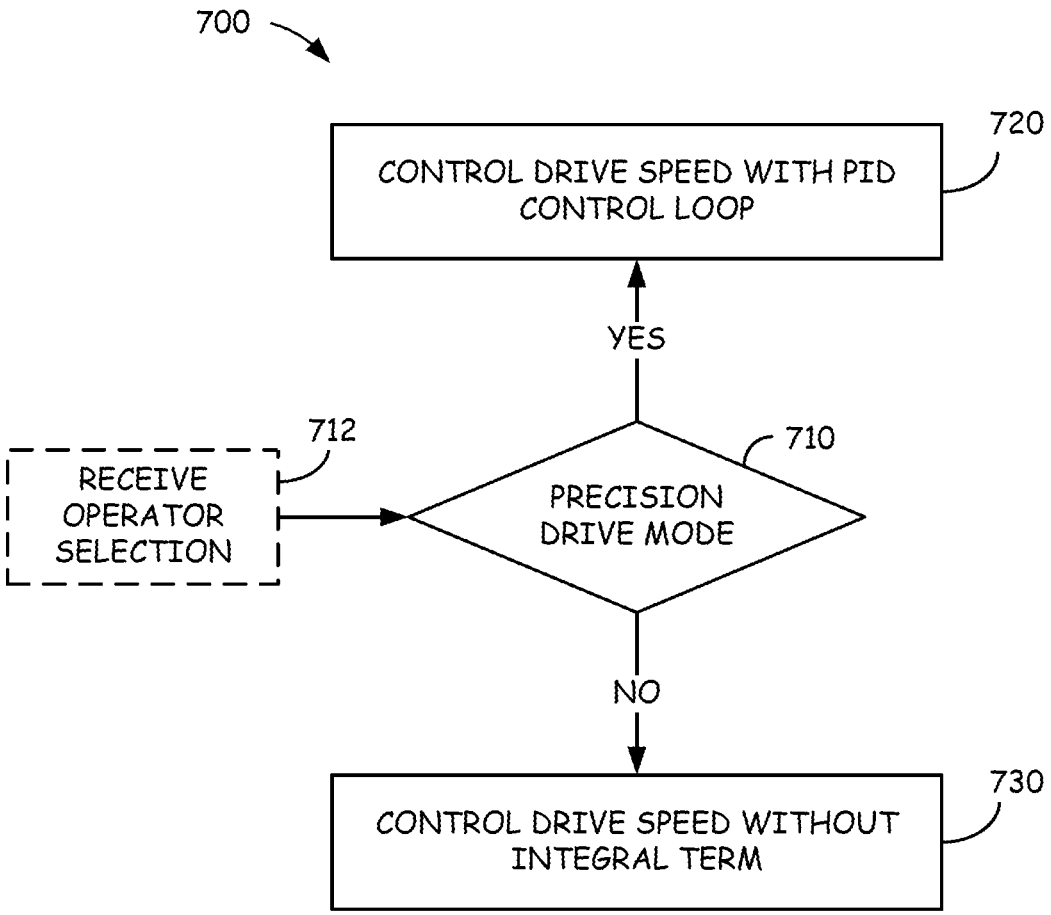

Referring in particular to FIG. 7, some implementations can include a method 700 for driving operations of a power machine, which can in some cases implement some or all of the functionality discussed above. In the illustrated example, at block 710, the method 700 can include determining whether a power machine is operating in a particular drive mode (e.g., a precision drive mode, as shown). In some cases, as generally noted above, the method 700 can correspondingly include receiving, at block 712, an operator input that indicates a selection of mode (e.g., an express selection of mode, or a lack of change from a default mode), and whether a particular mode is active can be determined at block 710 at least partly on the basis of that selection. In other cases, other parameters can additionally or alternatively affect the determination of a particular drive mode at block 710, including through monitoring of power consumption or other activity by various actuators. For example, some implementations can automatically identify a particular mode for present or future operation based upon identifying a pattern in a commanded or actual movement of non-tractive or other actuators (e.g., lift or tilt actuator movement corresponding to particular work operations, or non-movement of a lift or tilt actuator in combination with non-zero tractive power consumption).

Continuing with the example of FIG. 7, if a precision drive mode is active, the method 700 can include, at block 720, controlling drive speed with a PID control loop having a non-zero integral gain, as can provide relatively precise control over travel speed and may accordingly be particularly suitable for operations that require relatively fine speed control. In contrast, if the precision drive mode is not active (e.g., if a hydraulic-emulation mode is active), the method 700 can include, at block 730, controlling drive speed without an integral control term (e.g., with proportional but not integral control, or otherwise with zero integral gain). As noted above, operation at block 730 can accordingly result in improved power management for the power source and other components of the power machine, as well as improved operator comfort and other benefits associated with smoother travel over terrain. Correspondingly, depending on which drive mode is active (e.g., as selected by user input at block 712), a control system can selectively provide either drive control with greater overall precision, for improved performance of particular tractive operations, or drive control with reduced power fluctuation, including as may reduce overall wear on a battery from high-amplitude power cycles. Thus, the method 700 can provide selective control of drive operations for a power machine to match the needs of a particular work operation (e.g., to effectively balance precision of control, power management, and operator comfort).

In some examples, selective implementation of non-integral control can correspond to operation of a power machine in a hydraulic-emulation mode, under which certain actuators of a power machine are controlled to respond similarly to conventional hydraulic actuators. For example, in some hydraulic-emulation modes, elimination of integral control for drive speed can result in power machines drifting slightly with sloped terrain as do hydraulic machines due to unavoidable hydraulic leakage. In some examples, selective implementation of non-integral control can include continuing implementation of a current control loop but with a modified (e.g., zeroed) gain for the integral term.

Also as noted above, some examples can include control systems or methods for improved overall functionality of lift arms and other work elements, including by allowing selective operation of particular work elements in float mode. For example, when float mode is active for the power machine 500, the lift actuator 518 can be controlled so that the lift arm 504 is permitted to be moved by external forces (e.g., gravity or contact with the ground), with the lift actuator 518 being powered, as needed, to slow but not stop such movement. Thus, for example, effective floating movement of the lift arm 504 can be achieved, with minimal power losses due to unneeded operation of the actuator 518.

Figure 8:
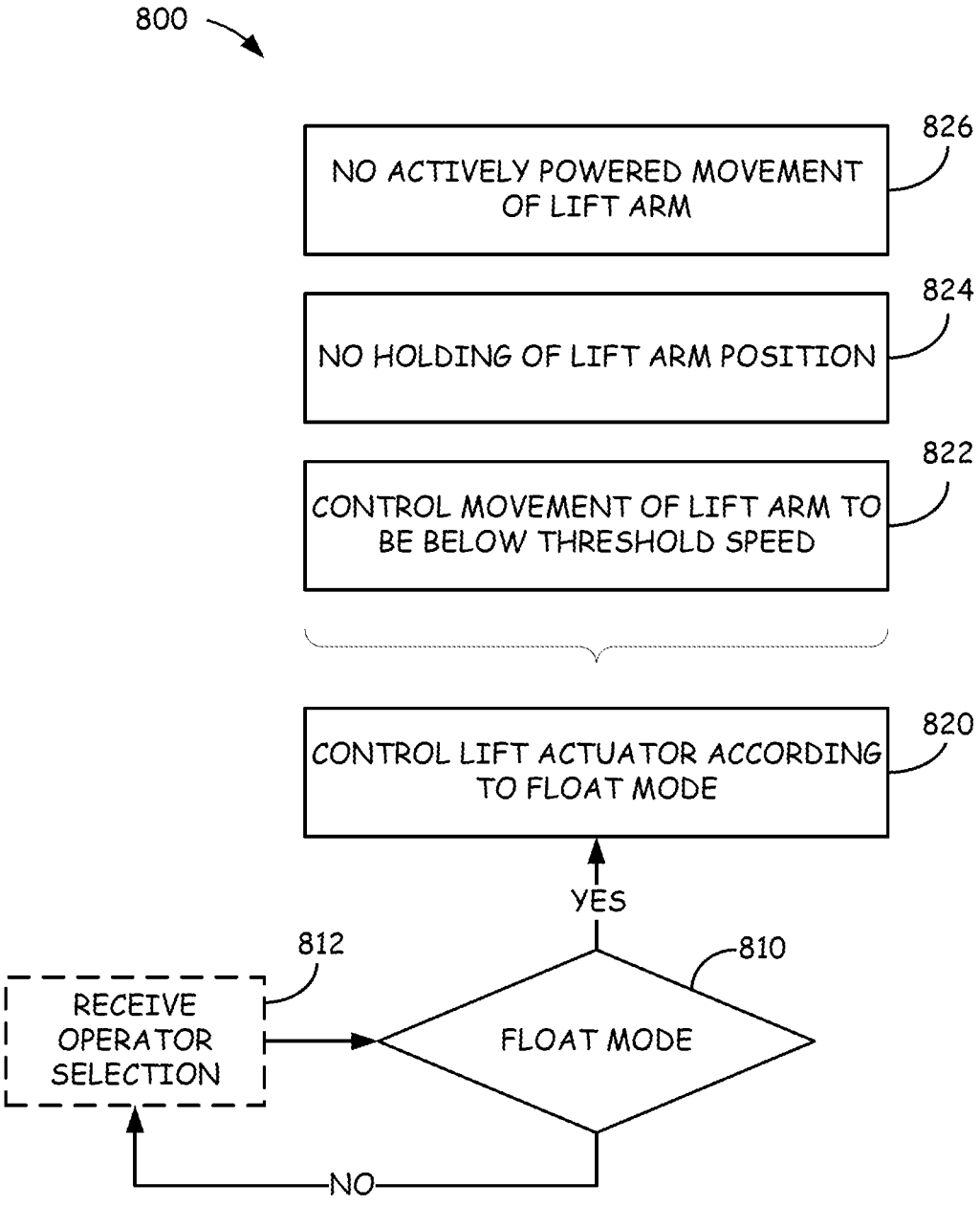

Referring in particular to FIG. 8, some implementations can include a method 800 for float operations of a work element (e.g., a lift arm). In the illustrated example, at block 810, the method 800 can include determining whether a power machine is operating in a float mode (e.g., a float mode for a lift arm, as shown). In some cases, as generally noted above, the method 800 can correspondingly include receiving, at block 812, an operator input that indicates a selection of mode (e.g., an express selection of a float mode, or a lack of change from a default float mode), and whether a particular float mode is active can be determined at block 810 at least partly on the basis of that selection.

Continuing with the example of FIG. 8, if a float mode is active, the method 800 can include, at block 820, controlling the lift (or other) actuator according to the active float mode. Generally, as noted above, operating a lift arm in a float mode can include controlling a lift actuator so that external forces can move the lift arm within a set of applicable constraints. For example, as illustrated in FIG. 8 (see curved bracket), controlling a lift actuator according to a float mode at block 820 can include, at block 822, controlling a lift actuator so that a speed of movement of a lift arm remains below a threshold speed (e.g., as corresponds to a threshold extension or retraction speed for a lift actuator). For example, based on a sensed speed of a movement of a lift arm under a float mode exceeding or approaching a relevant threshold, the method 800 can include providing current to an electrical lift actuator that partly opposes but does not stop the movement. As another example, the method can provide a small amount of current to partially oppose gravity regardless of whether there is any sensor to sense a movement speed of the lift arm (e.g., so that the weight of the lift arm does not alone result in movement of the lift arm toward the ground). In such cases, for example, although an actuator may be powered so as to hold position against the force of gravity, the actuator may generally not be powered so as to hold position against additional external forces that exceed the force of gravity (in a gravitational direction). Similarly, power provided to the actuator to hold against the force of gravity may be reduced in response to external forces that further oppose gravity (e.g., a contact force upward on a lift arm).

In some cases, controlling a lift actuator according to a float mode at block 820 can include, at block 824, controlling the lift actuator to not hold a position of a lift arm. For example, if zero movement of a lift arm (e.g., the lift arm 504) is detected, zero current may be provided to an associated lift arm actuator (e.g., the actuator 518) so that the actuator does not provide any active force to hold the lift arm in position. In this case, the lift arm can be free to move under the influence of gravity or contact with an external (e.g., ground) surface, in some cases without any control provided whatsoever by the actuator.

In some cases, controlling a lift actuator according to a float mode at block 820 can include, at block 826, controlling the lift actuator to provide no actively powered movement of the lift arm, but the controller may provide some non-zero level of current to provide some upward force to partially counteract gravity. For example, although a lift actuator can be controlled to prevent high speed movement of a lift arm due to application of an external load (e.g., gravity or ground contact) under a float mode (e.g., as discussed above), the lift actuator may also be controlled to actively actuate the lift actuator against the external load. In some cases, such active actuation can resist but not stop movement under the external load, but not actively move the lift arm (i.e., not cause a movement or supplement a movement caused by a net external loading). This can, for example, reduce the pressure applied by the lift arm to the ground or other external surfaces in the float mode.

Thus, examples of the disclosed power machine and components thereof can provide improvements over conventional designs. For example, some examples can provide improved calibration of lift arms or other work elements during startup operations, can help to reduce power surges and associated negative effects and also improve operator comfort during driving operations, and can provide improved functionality under a float mode for electrically powered work elements. Other benefits will also be apparent to those of skill in the art in view of the entirety of the disclosure.

Unless otherwise specified or limited, the terms "about" and "approximately," as used herein with respect to a reference value, refer to variations from the reference value of ±15% or less, inclusive of the endpoints of the range. Similarly, the term "substantially," as used herein with respect to a reference value, refers to variations from the reference value of ±5% or less, inclusive of the endpoints of the range.

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

In some examples, aspects of the disclosed technology, including computerized implementations of methods according to the disclosed technology, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, configurations of the disclosed technology can be implemented as a set of instructions, tangibly embodied on a non-transitory computer-readable media, such that a processor device can implement the instructions based upon reading the instructions from the computer-readable media. Some examples of the disclosed technology can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.). In some examples, a control device can include a centralized hub controller that receives, processes and (re)transmits control signals and other data to and from other distributed control devices (e.g., an engine controller, an implement controller, a drive controller, etc.), including as part of a hub-and-spoke architecture or otherwise.

The term "article of manufacture" as used herein is intended to encompass a computer program accessible from any computer-readable device, carrier (e.g., non-transitory signals), or media (e.g., non-transitory media). For example, computer-readable media can include but are not limited to magnetic storage devices (e.g., hard disk, floppy disk, magnetic strips, and so on), optical disks (e.g., compact disk (CD), digital versatile disk (DVD), and so on), smart cards, and flash memory devices (e.g., card, stick, and so on). Additionally, it should be appreciated that a carrier wave can be employed to carry computer-readable electronic data such as those used in transmitting and receiving electronic mail or in accessing a network such as the Internet or a local area network (LAN). Those skilled in the art will recognize that many modifications may be made to these configurations without departing from the scope or spirit of the claimed subject matter.

Certain operations of methods according to the disclosed technology, or of systems executing those methods, may be represented schematically in the FIGS. or otherwise discussed herein. Unless otherwise specified or limited, representation in the FIGS. of particular operations in particular spatial order may not necessarily require those operations to be executed in a particular sequence corresponding to the particular spatial order. Correspondingly, certain operations represented in the FIGS., or otherwise disclosed herein, can be executed in different orders than are expressly illustrated or described, as appropriate for particular examples of the disclosed technology. Further, in some examples, certain operations can be executed in parallel, including by dedicated parallel processing devices, or separate computing devices configured to interoperate as part of a large system.

As used herein in the context of computer implementation, unless otherwise specified or limited, the terms "component," "system," "module," "block," and the like are intended to encompass part or all of computer-related systems that include hardware, software, a combination of hardware and software, or software in execution. For example, a component may be, but is not limited to being, a processor device, a process being executed (or executable) by a processor device, an object, an executable, a thread of execution, a computer program, or a computer. By way of illustration, both an application running on a computer and the computer can be a component. One or more components (or system, module, and so on) may reside within a process or thread of execution, may be localized on one computer, may be distributed between two or more computers or other processor devices, or may be included within another component (or system, module, and so on).

Although the presently disclosed technology has been described with reference to preferred examples, workers skilled in the art will recognize that changes may be made in form and detail to the disclosed examples without departing from the spirit and scope of the concepts discussed herein.

What is claimed is:

1. A power machine comprising:

a main frame;

an electrical power source supported by the main frame;

a drive system that includes: one or more drive motors powered by the electrical power source and operatively coupled to tractive elements to provide tractive power for travel over terrain, and a suspension system that secures the tractive elements to the main frame; and a control system that includes one or more control devices configured to control drive speed of the one or more drive motors according to a first mode to execute precision operations, and according to a second mode to compensate for travel-induced oscillations on the suspension system, wherein under the second mode the control system controls the drive speed with substantially reduced integral gain as compared to the first mode.

2. The power machine of claim 1, wherein under the second mode the control system controls the drive speed by implementing proportional control without an integral control term.

3. The power machine of claim 1, wherein under the second mode the control system controls the drive speed with a proportional-integral-derivative (PID) control loop that includes an effectively zero integral gain.

4. The power machine of claim 3, wherein the control system is configured to implement the PID control loop under the first mode with an effectively non-zero integral gain.

5. The power machine of claim 4, wherein the control system is configured to implement the PID control loop under the first mode with a zero integral gain.

6. The power machine of claim 1, wherein the control system is configured to selectively operate in either of the first mode or the second mode in response to an operator input that indicates a selected one of the first or second modes.

7. The power machine of claim 1, wherein the control system is configured to selectively operate in either of the first mode or the second more based on monitoring operation of one or more actuators of the power machine.

8. The power machine of claim 1, wherein the tractive elements are tracked tractive elements.

9. A method of controlling drive operations of a power machine, the method comprising:

receiving a selection of a first drive mode or a second drive mode; and operating the power machine according to the selected first or second drive mode, wherein:

in the first drive mode, speed control of one or more electrical drive motors of the power machine is implemented with a proportional-integral-derivative (PID) control loop; and in the second drive mode, speed control of the one or more electrical drive motors is implemented with a proportional control loop.

10. The method of claim 9, wherein the first drive mode is a precision control drive mode.

11. The method of claim 9, wherein the second drive mode is a hydraulic-emulation drive mode.

12. The method of claim 9, wherein the second drive mode does not include a proportional-integral-derivative control loop.

13. The method of claim 9, wherein the proportional control loop corresponds to the PID control loop of the first drive mode, implemented with effectively zero integral gain.

14. A method of controlling drive operations of a power machine, the method comprising:

receiving a selection of a precision control drive mode or a hydraulic-emulation drive mode; and electronically controlling one or more drive motors that are powered by an electrical power source and operatively coupled to tractive elements, to provide tractive power for travel over terrain;

wherein, in response to receiving the selection of the precision control drive mode, the one or more drive motors are electronically controlled with effectively non-zero integral gain; and wherein, in response to receiving the selection of the hydraulic-emulation drive mode, the one or more drive motors are electronically controlled with effectively zero integral gain.

15. The method of claim 14, wherein the one or more drive motors are controlled with a first control loop with effectively non-zero integral gain in response to the selection of the precision drive mode, and are controlled with the first control loop with effectively zero integral gain in response to the selection of the hydraulic-emulation drive mode.

16. The method of claim 15, wherein the one or more drive motors are controlled with the first control loop with zero integral gain in response to the selection of the hydraulic-emulation drive mode.

17. The method of claim 14, wherein the one or more drive motors are controlled with zero integral gain in response to receiving the selection of the hydraulic-emulation drive mode.

18. The method of claim 14, wherein the one or more drive motors are controlled with a proportional-integral-derivative (PID) control loop with the effectively zero integral gain in response to receiving the selection of the hydraulic-emulation drive mode.

19. The method of claim 14, wherein receiving the selection includes receiving a user input that indicates a commanded drive mode.

20. The method of claim 19, wherein receiving the selection includes automatically identifying the selection based on identifying a commanded or actual movement of a non-tractive actuator of the power machine.

* * * * *